US009102459B2

(12) United States Patent
Milican et al.

(10) Patent No.: US 9,102,459 B2
(45) Date of Patent: Aug. 11, 2015

(54) DUAL LAYER PACKAGING WITH EXPANDABLE INNER LAYER

(75) Inventors: Shannon Milican, El Cajon, CA (US); Fred Pisacane, San Diego, CA (US)

(73) Assignee: Foamtec International Co., Ltd., Oceanside, CA (US)

( * ) Notice: Subject to any disclaimer, the term of this patent is extended or adjusted under 35 U.S.C. 154(b) by 282 days.

(21) Appl. No.: 12/577,940

(22) Filed: Oct. 13, 2009

(65) Prior Publication Data

US 2010/0089007 A1 Apr. 15, 2010

Related U.S. Application Data

(60) Provisional application No. 61/104,923, filed on Oct. 13, 2008.

(51) Int. Cl.

| | |
|---|---|
| ***B65D 75/38*** | (2006.01) |
| ***B65B 11/58*** | (2006.01) |
| ***B65B 55/20*** | (2006.01) |
| ***B31B 7/00*** | (2006.01) |
| ***B65D 85/16*** | (2006.01) |
| ***B65D 77/04*** | (2006.01) |

(52) U.S. Cl.

CPC ..... *B65D 85/16* (2013.01); *B65D 75/38* (2013.01); *B65D 77/04* (2013.01); *Y10T 428/1334* (2015.01)

(58) Field of Classification Search

CPC ..... B65D 75/38; B65D 85/16; B65D 77/04; B65B 11/58; B65B 55/20; B65B 25/026; B31B 7/00

USPC ..... 53/436, 415, 438, 111 R, 523, 527, 529, 53/530, 170, 171, 173

See application file for complete search history.

(56) References Cited

U.S. PATENT DOCUMENTS

| | | | | |
|---|---|---|---|---|
| 3,096,879 | A * | 7/1963 | Schumacher | 206/523 |
| 3,362,128 | A * | 1/1968 | James | 53/436 |
| 3,458,966 | A * | 8/1969 | Hullhorst et al. | 53/430 |
| 3,918,584 | A * | 11/1975 | Richardson | 206/497 |
| 4,054,204 | A * | 10/1977 | Keeton | 206/83.5 |
| 4,555,017 | A * | 11/1985 | Blackmore | 206/83.5 |
| 4,793,490 | A * | 12/1988 | Evert | 206/497 |
| 4,799,350 | A * | 1/1989 | Rias | 53/399 |
| 4,936,460 | A * | 6/1990 | Meyer | 206/524.8 |
| 5,350,063 | A * | 9/1994 | Berdan, II | 206/321 |
| 5,897,418 | A * | 4/1999 | Spector | 446/268 |
| 6,575,807 | B2 * | 6/2003 | Spector | 446/320 |
| 6,926,146 | B2 * | 8/2005 | Gheblikian | 206/425 |
| 6,952,906 | B2 * | 10/2005 | Nelson | 53/434 |

(Continued)

FOREIGN PATENT DOCUMENTS

| | | | | |
|---|---|---|---|---|
| JP | 57046850 A * | 3/1982 | | B29C 27/06 |
| WO | WO 88/10220 | 12/1988 | | |
| WO | WO 98/30471 | 7/1998 | | |

OTHER PUBLICATIONS

International Search Report and Written Opinion from corresponding Int'l Application No. PCT/US09/060463 dated Dec. 22, 2009.

*Primary Examiner* — Michelle Lopez

(74) *Attorney, Agent, or Firm* — Zeman-Mullen & Ford, LLP

(57) ABSTRACT

A dual layer packaging for shipping compressible items or goods includes an inner expandable layer and an outer non-expandable layer.

20 Claims, 4 Drawing Sheets

(56) References Cited

U.S. PATENT DOCUMENTS 7,698,762 B2 * 4/2010 Hasan et al. ..... 5/634
7,895,813 B2 * 3/2011 Andria et al. ..... 53/399
2003/0183550 A1 * 10/2003 DiLiberto, Jr. ..... 206/524.8
2003/0201294 A1 * 10/2003 Gam ..... 224/617
2008/0086984 A1 * 4/2008 Andria et al. ..... 53/434
2009/0293431 A1 * 12/2009 Andria et al. ..... 53/438

* cited by examiner

DUAL LAYER PACKAGING WITH EXPANDABLE INNER LAYER

CROSS-REFERENCE TO RELATED APPLICATIONS

This application claims the benefit of U.S. Provisional Application No. 61/104,923, filed Oct. 13, 2008 which is herein incorporated by reference in its entirety.

FIELD OF THE INVENTION

The present invention generally relates to packaging for shipping compressible items or goods. More particularly, the present invention relates to a dual layer packaging which includes an inner expandable layer which is capable of covering the compressible goods in a compressed state and an outer non-expandable layer which covers the inner expandable layer containing the compressible goods in a compressed state such that removal of the outer non-expandable layer of the packaging results in the goods expanding to their uncompressed state while contained in the inner expandable layer of the packaging.

BACKGROUND OF THE INVENTION

Compressible items or goods are typically shipped in their compressed state in order to include more of the items or goods in a bulk shipping container thereby reducing shipping and transportation costs. However, once the compressed goods reach their shipping destination, they must be uncompressed and then repackaged in final packaging for stocking on retailer shelves. Although the compressible goods could be shelved and sold in their compressed state, retailers are reluctant to do so because they fear customers will not purchase products that do not appear to be in their normal usable state. In particular, they suspect customers will not buy products that do not appear to be suitable for their intended purpose.

One example of compressible goods that are shipped in their compressed state is sponges. Sponges are typically compressed in large bales containing anywhere from two hundred to five hundred sponges prior to shipping. The size of the sponges contained in a given bale may be anywhere from four times to eight times smaller than the sponge is in its uncompressed or natural state. Once the bales of sponges are shipped to their final destination, they are uncompressed, i.e. allowed to expand to their natural state, and then repackaged in their natural uncompressed state for sale on retail shelves. The repackaging of the sponges to a retail shelf pack adds material costs and labor costs.

Accordingly, there is a need for an efficient packaging system that enables compressible products to be shipped in a compressed state and which further enables the compressed products to quickly expand to their normal state for placement on retail shelves without the need for repackaging.

SUMMARY OF THE INVENTION

The present invention is directed to a dual layer packaging with an expandable inner material layer and a separate outer non-expandable material layer which covers the inner expandable material layer. Compressible goods are placed within the dual layer packaging in a compressed state for shipping. Once the compressed goods arrive at their shipping destination, the outer non-expandable material layer is removed so that the goods are only contained in the inner expandable material layer thereby allowing the compresses goods to expand to their natural or uncompressed state.

The inner expandable material layer may be comprised of any expandable material such as a nylon material, an expandable knit material, or any other material capable of being easily stretched or expanded without a great deal of force. The outer non-expandable material layer may be comprised of any plastic material, polymer material, or the like which is not easily stretched or expanded thereby being capable of containing compressed goods in their compressed state.

In one aspect of the dual layer packaging of the present invention, a product label may be placed within the inner expandable material layer along with the product prior to enclosing the product within the inner expandable material layer. The inner expandable material layer may be somewhat transparent to enable one to read the product label through the inner expandable material label thereby eliminating the need to label the uncompressed product after the outer non-expandable material layer is removed. The outer non-expandable material layer may also be somewhat transparent to enable one to read the product label through both the inner expandable material layer and the outer non-expandable material layer when the product is in a compressed state.

The present invention is also directed to a dual layer packaging system and method which includes the steps of enclosing a compressible good in a first expandable material layer, compressing the compressible good contained in the first expandable layer until it is in a compressed state, and enclosing the compressed good contained in the first expandable layer in a second non-expandable material layer which retains the compressed good and first expandable layer in a compressed state. Once the compressed good arrives at its shipping destination, or once it is desired to display the compressed good in its natural state, the second non-expandable material layer is removed thereby allowing the compressed good to expand to its natural state within the first expandable material layer.

BRIEF DESCRIPTION OF THE DRAWINGS

The subject invention will hereinafter be described in conjunction with the appended drawing figures, wherein like numerals demote like elements.

DETAILED DESCRIPTION OF EXEMPLARY EMBODIMENTS

Figure 4:
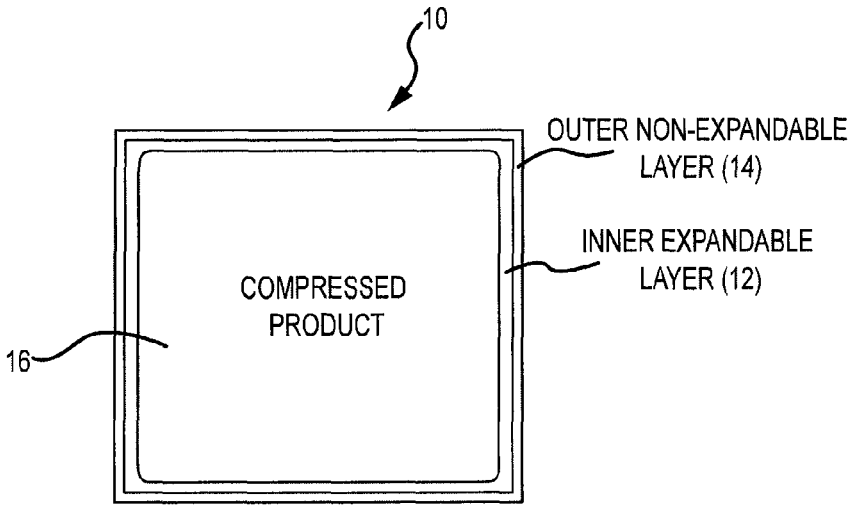
FIG. 4 is a magnified side elevational view of the dual layer packaging of the present invention shown with compressed product contained within the dual layer packaging.
Figure 5:
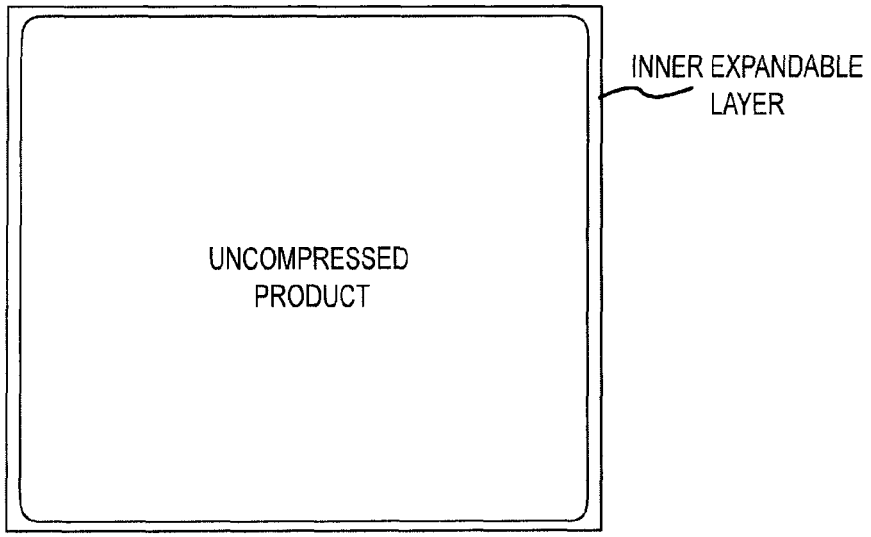
FIG. 5 is a magnified side elevational view of the dual layer packaging of the present invention shown in FIG. 4 with the outer non-expandable material layer of the dual layer packaging removed thereby allowing the compressed product to expand to its natural state within the inner expandable material layer.

The dual layer packaging 10 of the present invention for packaging a compressible product generally includes an expandable inner material layer 12 and a separate outer non-expandable material layer 14 which covers the inner expandable material layer 12 (see FIG. 4). FIG. 4 is a magnified side elevational view of the dual layer packaging of the present invention shown with a compressed product 16 contained within the dual layer packaging 10. Once the product contained in the dual layer packaging 10 of the present invention arrives at its desired destination, the outer non-expandable layer 14 is removed to allow the compressed product 16 to expand to its natural state within the inner expandable material layer 12. FIG. 5 is a magnified side elevational view of the dual layer packaging 10 of the present invention shown in FIG. 4 with the outer non-expandable material layer 14 of the dual layer packaging 10 removed thereby allowing the compressed product 16 to expand to its natural state within the inner expandable material layer 12.

Figure 1:
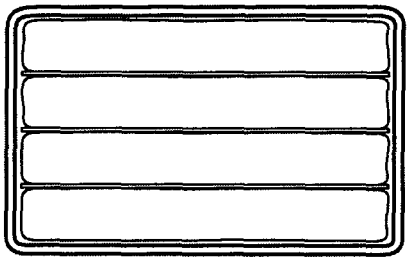
FIG. 1 is a perspective view of the dual layer packaging of the present invention shown with sponges contained in the dual layer packaging in a compressed state.
Figure 2:
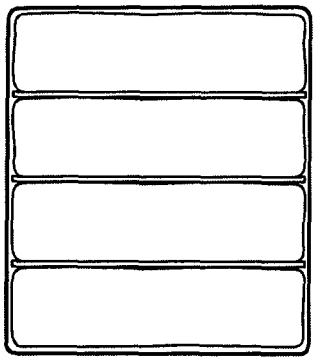
FIG. 2 is a perspective view of the dual layer packaging of the present invention shown in FIG. 1 with the outer non-expandable material layer of the dual layer packaging removed thereby allowing the sponges to expand to their natural state within the inner expandable material layer.

FIG. 1 is a perspective view of the dual layer packaging 10 of the present invention shown with sponges (an exemplary compressible product) contained in the dual layer packaging 10 in a compressed state. Once the sponges arrive at their desired destination, the outer non-expandable layer 14 is removed. FIG. 2 is a perspective view of the dual layer packaging 10 of the present invention shown in FIG. 1 with the outer non-expandable material layer 14 of the dual layer packaging 10 removed thereby allowing the sponges to expand to their natural state within the inner expandable material layer 12.

The inner expandable material layer may be comprised of any expandable material such as a nylon material, an expandable knit material, or any other material capable of being easily stretched or expanded without a great deal of force. The outer non-expandable material layer may be comprised of any plastic material, polymer material, or the like which is not easily stretched or expanded thereby being capable of containing compressed goods in their compressed state. Either one or both of the inner expandable material layer and outer non-expandable material layer may be transparent.

Figure 3:
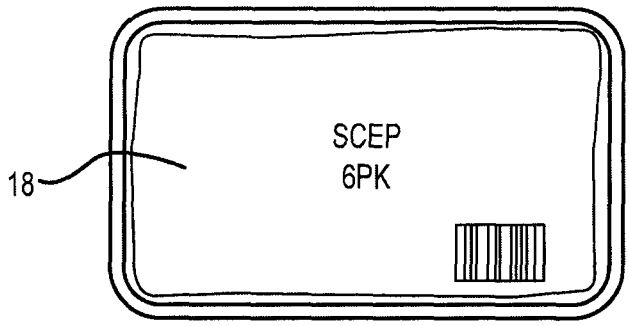
FIG. 3 is a top plan view of the dual layer packaging system of the present invention shown in FIG. 1 with the label of the product showing through both the inner expandable material layer and the outer non-expandable material layer.

A product label may be placed within the inner expandable material layer 12 along with the product prior to enclosing the product within the inner expandable material layer 12. If the inner expandable material layer 12 is transparent, then the product label placed between the compressed product 16 and the inner expandable layer 12 can be viewed through the inner expandable material layer 12. This eliminates the need to label the uncompressed product after the outer non-expandable material layer 14 is removed. The outer non-expandable material layer may also be somewhat transparent to enable one to read the product label through both the inner expandable material layer 12 and the outer non-expandable material layer 14 when the product is in a compressed state. FIG. 3 is a top plan view of the dual layer packaging 10 of the present invention shown in FIG. 1 with the label 18 of the product showing through both the inner expandable material layer 12 and the outer non-expandable material layer 14.

Figure 6:
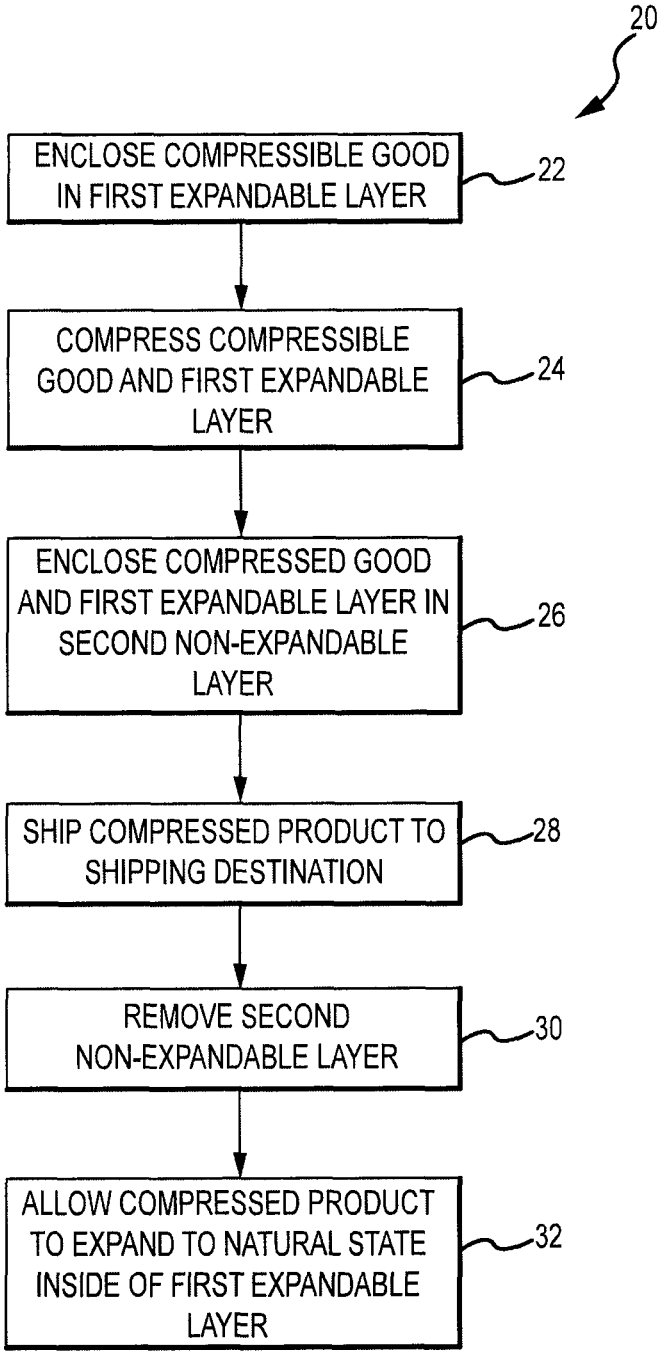
FIG. 6 is a flowchart showing the dual packaging system and method of the present invention.

FIG. 6 is a flow chart showing the dual packaging system and method of the present invention. The dual layer packaging system of the present invention includes means for enclosing a compressible good in a first expandable material layer, means for compressing the compressible good contained in the first expandable material layer until it is in a compressed state, and means for enclosing the compressed good contained in the first expandable material layer in a second non-expandable material layer which retains the compressed good and first expandable material layer in a compressed state. The dual layer packaging system may further comprise means for removing the second non-expandable material layer to allow the compressed good to expand to its natural state within the first expandable material layer. This means may be as simple as manually removing the second non-expandable material layer. The dual layer packaging system of the present invention may also include means for placing a product label between the compressible good and the first expandable material layer where the first expandable material layer is transparent thereby enabling a purchaser or consumer to view the type of product and product information.

The present invention also includes a method for packaging a compressible good 20 which includes enclosing a compressible good in a first expandable layer in step 22, compressing the compressible good and first expandable layer in step 24, and enclosing the compressed good and first expandable layer in a second non-expandable layer in step 26. The compressed product is then shipped to its shipping destination in step 28 and once it arrives at its shipping destination, the second non-expandable layer is removed in step 30. Once the second non-expandable layer is removed from the compressed product, the compressed product is allowed to expand to its natural state inside of the first expandable layer in step 32. The method for packaging of compressible good may also include the step of placing a product label between the compressible good and the first expandable material layer thereby eliminating the need to re-label the product once the second non-expandable layer is removed.

Although the invention has been described herein in conjunction with the appended drawings, those skilled in the art will appreciate that the scope of the invention is not so limited. Modifications in the selection, design, and arrangement of the various components and steps discussed herein may be made without departing from the scope of the invention.

The invention claimed is:

1. A dual layer packaging comprised of:

an inner expandable material layer comprising at least one of a stretchable nylon material and a stretchable knit material; and an outer non-expandable material layer.

2. The dual layer packaging of claim 1 wherein the inner expandable material layer is transparent.

3. The dual layer packaging of claim 2 further comprised of a product label placed inside of the inner expandable material layer.

4. The dual layer packaging of claim 3 wherein the outer non-expandable material layer is transparent.

5. The dual layer packaging of claim 1 wherein the outer non-expandable material layer comprises at least one of a plastic material or a polymer material.

6. The dual layer packaging of claim 1 wherein the inner expandable material layer and the outer non-expandable material layer are both transparent.

7. The dual layer packaging of claim 6 further comprised of a product label placed inside of the inner expandable material layer.

8. A method for packaging a compressible good comprised of the steps of:

enclosing the compressible good in a first expandable material layer comprising at least one of a stretchable nylon material and a stretchable knit material;

compressing the compressible good contained in the first expandable material layer until it is in a compressed state; and enclosing the compressed good contained in the first expandable material layer in a second non-expandable material layer which retains the compressed good and first expandable material layer in a compressed state.

9. The method of claim 8 further comprised of the step of removing the second non-expandable material layer to allow the compressed good to expand to its natural state within the first expandable material layer.

10. The method of claim 8 wherein the step of enclosing a compressible good in a first expandable material layer comprises the step of enclosing a compressible good in a first transparent material layer.

11. The method of claim 10 further comprised of the step of placing a product label between the compressible good and the first expandable material layer.

12. The method of claim 11 further comprised of the step of removing the second non-expandable material layer to allow the compressed good to expand to its natural state within the first expandable material layer.

13. The method of claim 11 wherein the step of enclosing the compressed good contained in the first expandable material layer in a second non-expandable material layer which retains the compressed good and first expandable material layer in a compressed state comprises the step of enclosing the compressed good contained in the first expandable material layer in a second transparent non-expandable material layer.

14. A dual layer packaging comprised of:

an inner expandable material layer comprising at least one of a stretchable nylon material without laminate and a stretchable knit material without laminate; and an outer non-expandable material layer.

15. The dual layer packaging of claim 14 wherein the inner expandable material layer is transparent.

16. The dual layer packaging of claim 15 further comprised of a product label placed inside of the inner expandable material layer.

17. The dual layer packaging system of claim 16 wherein the outer non-expandable material layer is transparent.

18. The dual layer packaging of claim 14 wherein the outer non-expandable material layer comprises at least one of a plastic material or a polymer material.

19. The dual layer packaging of claim 14 wherein the inner expandable material layer and the outer non-expandable material layer are both transparent.

20. The dual layer packaging of claim 19 further comprised of a product label placed inside of the inner expandable material layer.

* * * * *